United States Patent [19]

Schaefer

[11] Patent Number: 4,508,491

[45] Date of Patent: Apr. 2, 1985

[54] MODULAR UNLOAD SLIDE VALVE CONTROL ASSEMBLY FOR A HELICAL SCREW ROTARY COMPRESSOR

[75] Inventor: Donald D. Schaefer, Farmington, Conn.

[73] Assignee: Dunham-Bush, Inc., West Hartford, Conn.

[21] Appl. No.: 452,231

[22] Filed: Dec. 22, 1982

[51] Int. Cl.[3] ..... F04B 49/08

[52] U.S. Cl. ..... 417/310; 417/440; 418/201

[58] Field of Search ..... 62/228.5, 226; 91/6, 91/32; 417/440, 310; 418/201

[56] References Cited

U.S. PATENT DOCUMENTS

| | | | |
|---|---|---|---|
| 3,408,827 | 11/1968 | Soumerai et al. | 62/210 X |
| 4,342,199 | 8/1982 | Shaw et al. | 62/196.3 |
| 4,388,048 | 6/1983 | Shaw et al. | 417/310 |
| 4,412,788 | 11/1983 | Shaw et al. | 417/310 |

*Primary Examiner*—Richard E. Gluck
*Attorney, Agent, or Firm*—Sughrue, Mion, Zinn, Macpeak, and Seas

[57] ABSTRACT

A modular three block assembly provides unloading control for a hydraulic cylinder functioning to variably position a slide valve on a helical screw rotary compressor. A first compressor block is fixedly and sealably mounted within the hermetic compressor outer casing and has through holes leading to a first tube connected to a source of oil under discharge pressure forming the hydraulic fluid for the hydraulic cylinder, a second tube connected to the hydraulic cylinder and a third tube to the suction tube returning low pressure vapor to the compressor suction side. A needle valve block is fixedly mounted to the external face of the compressor block and bears within longitudinal through passages paired needle valves determining the load and unload flow rates for the hydraulic fluid passing through said compressor block through holes. A solenoid valve block face connected to the needle valve block carries a three position solenoid valve assembly for controlling flow through the various passages leading to the internal tubes. Flow distribution plates of gasket material are interposed between the blocks at the block interfaces to seal the block interfaces and to provide lateral flow distribution between the various passages through the blocks interconnecting the tubes and under control of the solenoid valve assembly. Elimination of external tubing insures oil of low viscosity for proper operation at compressor start up and significantly reduces complexity and cost to the control system.

6 Claims, 12 Drawing Figures

MODULAR UNLOAD SLIDE VALVE CONTROL ASSEMBLY FOR A HELICAL SCREW ROTARY COMPRESSOR

FIELD OF THE INVENTION

This invention relates to a helical screw rotary compressor having a hydraulic cylinder operated unloading slide valve and more particularly to a compact modular unloading control valve assembly integrated to the helical screw rotary compressor hermetic casing.

BACKGROUND OF THE INVENTION

There have developed over the years hermetic helical screw rotary compressor units particularly useful in the refrigeration and air conditioning field characterized by an outer hermetic casing which houses, in an axial array, an inner casing bearing intermeshed helical screw rotors and an electric motor at one end of the intermeshed rotors. The electric motor rotor is shaft connected directly to one of the intermeshed helical screw rotors to drive the other of said helical screw rotors. The hermetic outer casing may additionally include primary, secondary and even tertiary oil separators to effect discharge of a substantially oil free refrigerant in vapor form from the outer hermetic casing. Oil for lubricating and sealing purposes, as well as for inducing some cooling action to the compression process, may be injected under pressure at various points along the inner casing housing the intermeshed helical screw rotors, as for instance at an injection port opening to the intermeshed helical screw threads defining a closed thread or compression chamber, and at bearings for the motor rotor if separate bearings are provided for that component.

In such hermetic helical screw rotary compressor systems or units, particularly of hermetic design, in order to vary the capacity of the compressor from full load to full unload, there has developed the use of a slide valve which is axially shiftable relative to the compressor inner casing and covers a return passage returning a portion of the working fluid, prior to compression, to the inlet or suction port of the machine, i.e. bypassing the compression process depending upon the system load requirements. In order to shift the slide valve, there is conventionally provided a hydraulic cylinder in which the cylinder sealably houses a slidable piston which is displaceable in a direction to load the compressor and which is directly fixed by a piston rod to the slide valve. Spring means or other means tend to bias the slide valve to full unload position, absent the application of hydraulic fluid such as oil under pressure to a chamber at one side of the piston to drive the slide valve towards full load.

One such arrangement is exemplified by U.S. Pat. No. 3,408,827 to H. Soumerai et al issued Sept. 19, 1967, and assigned to the common corporate assignee. In that refrigeration system, oil separated within the hermetic outer casing downstream from the electric drive motor or in conjunction therewith is directed to an oil sump, external of the hermetic unit, via suitable tubing and the lubricating oil at essentially compressor discharge pressure is employed as the hydraulic fluid for the slide valve operating hydraulic cylinder. Oil supplied to a closed chamber to one side of the piston within the slide valve hydraulic cylinder selectively drives the slide valve towards compressor full load position. Again, piping or tubing leads from the sump externally of the hermetic unit to the hydraulic cylinder.

Additional U.S. patents such as patents U.S. Pat. Nos. 3,738,116 to Edward S. Gazda issuing June 12, 1973, and 3,795,117 issuing Mar. 5, 1974, to Harold W. Moody Jr. et al, both assigned to the common assignee, highlight the complex tubing or piping needed for supplying hydraulic oil to the hermetic compressor unit controlled by various solenoid operated and other valves within the lines leading from the oil sump and/or oil cooler to the hermetic compressor unit. Even where the hermetic unit outer casing functions as the oil sump, as for instance in vertical axis hermetic compressor units, and when there is no external oil sump or cooler, it is conventional to feed oil for the hydraulic cylinder driving the unloading slide valve through various pipes or tubes, manifolds and the like via parallel lines to and from the compressor with suitable shutoff valves, needle valves, solenoid operated control or metering valves, all within tubing or piping external of the inner casing. Necessarily, a long length path exists from the source of the oil to the point of ultimate use, and additionally, the control valves, needle valves and the like, exterior of the hermetic unit, are subject to ambient temperature conditions. All of this adversely affects the response time and in fact the quality of the control, particularly at the time compressor operation is initiated and the refrigeration and/or air conditioning system employing the same is at "start up".

As an example of problems which exist in the field, when a hermetic helical screw rotary compressor system shuts down, the oil within the lines external of the compressor hermetic casing and leading to and from the various control valves, needle valves and the like, is subjected to significant viscosity change. Under relatively cold ambient temperature conditions, this oil which functions as the hydraulic fluid for operating the slide valve unload cylinder, becomes highly viscous with subsequent delay in slide valve operation or actual prevention of slide valve shifting due to the high viscosity of the oil initially fed to the closed cylinder chamber bearing the slide valve piston.

As may be appreciated, since the needle valves meter the flow, and thus the response of the slide valve hydraulic cylinder to a system load or unload signal, the highly viscous oil is either unable to flow through the unload or load rate needle valves or flow is substantially reduced. In the past, the compressor unit operator may mechanically adjust, i.e. open the needle valves at start up and reset the needle valves after warm up for normal operation. Such operation seriously affects the quality of the compressor operation, requires adjustments both at time of starting and subsequent thereto, and is highly inappropriate.

Additionally, another problem exists. The oil which occupies a portion of the hermetic outer casing along with the refrigerant at discharge pressure, tends to pick up refrigerant since the refrigerant is miscible in the oil. When the lubricating oil is then used as the hydraulic fluid for the unloading cylinder, the refrigerant in the oil expands when the pressure is reduced and as the oil is bled back to the suction side of the machine under compressor unloading. However, the expansion tends to create a gas volume replacing the oil in the slide valve cylinder behind the piston, so that the piston will not move, irrespective of continued pulsing, i.e. a control signal attempting to effect slide valve cylinder piston shifting towards unload direction.

It is, therefore, a primary object of the present invention to provide a modular unloading slide valve control assembly which utilizes lubricating oil under compressor discharge pressure as a source of hydraulic fluid for the slide valve unloading cylinder, wherein the oil lines for the system are substantially reduced in length, the components are in modular form, and are integrated to compressor hermetic casing so that the oil within the control valve passages is maintained at near oil sump temperature, wherein the control system components may be readily adjusted, modular portions thereof readily replaced, and wherein the system is substantially reduced in cost as compared to prior practice.

SUMMARY OF THE INVENTION

The present invention is directed to a hermetic helical screw rotary compressor for a closed loop refrigeration system or the like having refrigerant circulating therein with the compressor comprised of a hermetic outer casing receiving the discharge of the compressor, an inner casing defining with a pair of intermeshed helical screw rotors rotatably mounted therein defining a compressor compression chamber, a suction port within the inner casing opening to the compression chamber, a capacity control slide valve hydraulic cylinder mounted to the inner casing and including a piston slidably and sealably mounted within the hydraulic cylinder and defining with the cylinder a closed chamber, a compression suction tube connected to the closed loop system and supplying refrigerant in vapor form to the suction port of the compressor, oil for lubricating and sealing purposes within the outer compressor casing and being subject to the discharge pressure of the compressed refrigerant vapor, a first tube in communication with the oil within the sump for providing a supply of oil as hydraulic fluid at compressor discharge pressure for the hydraulic cylinder and forming a first line, a second tube connected to the hydraulic cylinder for delivering the hydraulic fluid to the cylinder closed chamber and for removing hydraulic fluid from the cylinder closed chamber and for removing the hydraulic fluid therefrom and forming a second line, a third tube connected to the compressor suction tube for returning working fluid to the suction port of the compressor and forming a third line. An unload rate needle valve is provided within the third line, a load rate needle valve is provided within the first line, and solenoid valve means selectively connects or disconnects ones of the first and second and third lines.

The improvement comprises a modular, multi-block unloading control valve assembly, the assembly comprising a compressor block fixedly and sealably mounted within the hermetic compressor outer casing and having internal and external faces, the compressor block including holes extending through the same and forming parts of the first, second and third lines and being connected to the ends of the first, second and third tubes, respectively, so as to maintain the exposed tubes internally of the hermetic outer casing. A needle valve block is fixedly mounted to the external face of the compressor block with the needle valve block including passages extending therethrough from one face to the other, one of the passages carrying a pressure relief valve and others, the unload rate needle valve and the load rate needle valve respectively with the needle valves including valve needles adjustably projecting into the open ends of compressor block through holes forming parts of the respective first and third lines. The solenoid valve means comprises a three way solenoid valve including a solenoid valve block fixedly mounted in face abutting position on the needle valve block, a normally open unload plunger, a normally closed load plunger, and passages opening to the plungers and being connected to respective passages carried by the needle valve block. Means are provided for removably, sealably fixing the blocks in a stacked array in end facing position including means for fluid connecting respective passages of the blocks at their interfaces, such that the fluid passages being internal of the compressor block, the needle valve block and the solenoid valve block insure minimum viscosity to the oil carried thereby as a result of compressor shut down for assured, proper slide valve operation at compressor start up.

The means for removably, sealably fixing the blocks in a stacked array preferably comprise flow distribution plates sealably sandwiched between facing ends of respective blocks, the flow distribution plates comprising elongated slots formed within the plates and functioning to permit lateral flow between laterally offset longitudinal passages of respective blocks sandwiching a given flow distribution plate.

DESCRIPTION OF THE PREFERRED EMBODIMENT

Figure 1:
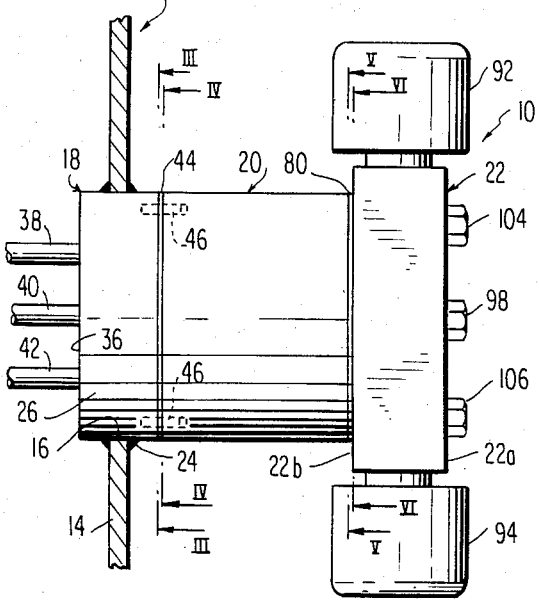
FIG. 1 is a side elevational view of a portion of a hermetic helical screw rotary compressor outer casing mounting the modular multi-block unloading control valve assembly forming one embodiment of the present invention.
Figure 2:
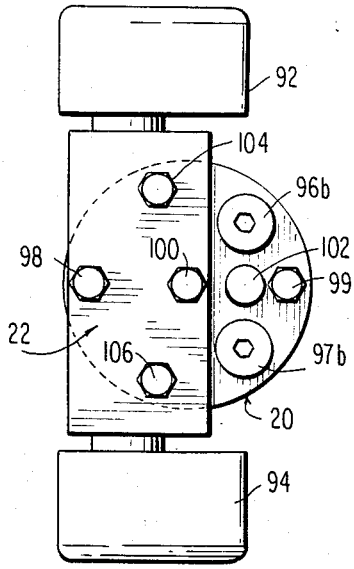
FIG. 2 is an end view of the control valve assembly illustrated in FIG. 1.
Figure 3:
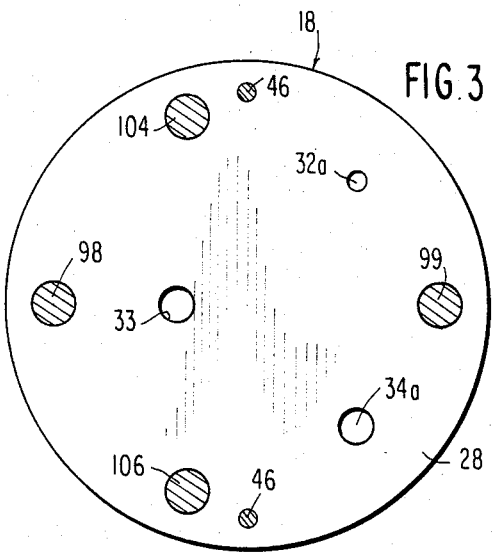
FIG. 3 is a sectional view taken about line III—III of FIG. 1.
Figure 4:
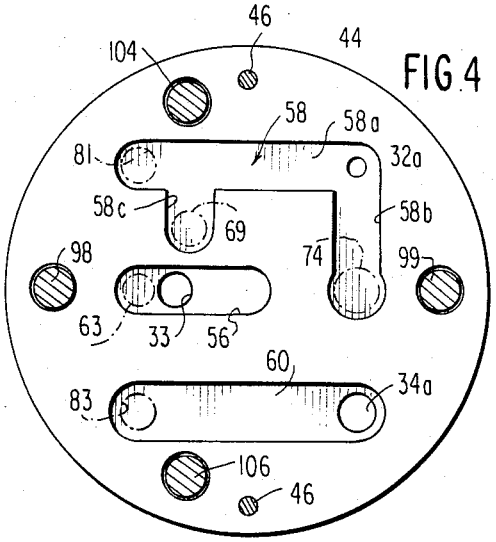
FIG. 4 is a sectional view taken about line IV—IV of FIG. 1.
Figure 5:
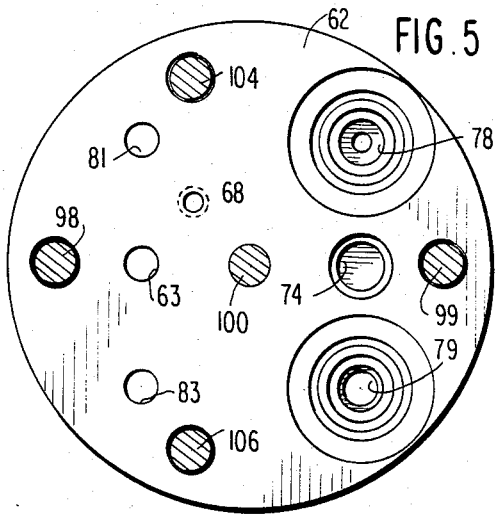
FIG. 5 is a sectional view taken about line V—V of FIG. 1.
Figure 6:
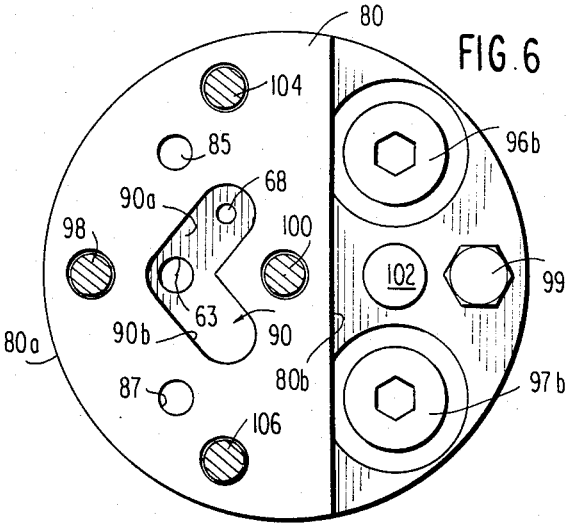
FIG. 6 is a sectional view taken about line VI—VI of FIG. 1.

The modular, unloading control valve indicated generally at 10 is, in multi-block, face-to-face assembly form, and is physically integrated into the hermetic helical screw rotary compressor indicated generally at 12, FIG. 1, by being physically mounted to the compressor outer hermetic housing 14. In that respect, the compressor hermetic housing 14 is provided with a circular hole as at 16 within which is mounted a compressor block or pad indicated generally at 18 and which may be welded thereto at its periphery by way of welds 24 for high pressure sealing of compressor block or mounting pad 18 to the hermetic unit. The modular control valve 10, in addition to block 18, is comprised principally of two additional blocks, an intermediate needle valve block 20 and a solenoid valve block 22.

The compressor block or mounting pad 18 is of circular disc form, and may be of steel or other suitable metal, as may be blocks 20 and 22. Block 18 is provided with a peripheral edge or side 26, an external face 28 and an internal face 36. Four mounting holes 30 are drilled and tapped within external face 28 circumferentially spaced about 90° to each other for receiving the threaded ends of mounting screws 98, 99, 104 and 106; the headed ends of which are borne by the solenoid valve block 22 or needle valve block 20. The external face 28 additionally bears holes 45 within which mount locator pins 46 diametrically opposed and offset from holes 30 for properly positioning of a first flow control plate or gasket 44. The pins 46 are received within locator holes 48 within that plate, FIG. 7, as well as holes 47 within the needle valve block 20. Block 20 paired holes 47 are at positions within its end face 64 corresponding to the location of pins 46 within the compressor block 18 and locator holes 48 within flow distribution plate 44.

Figures 7, 8, 9, 10:
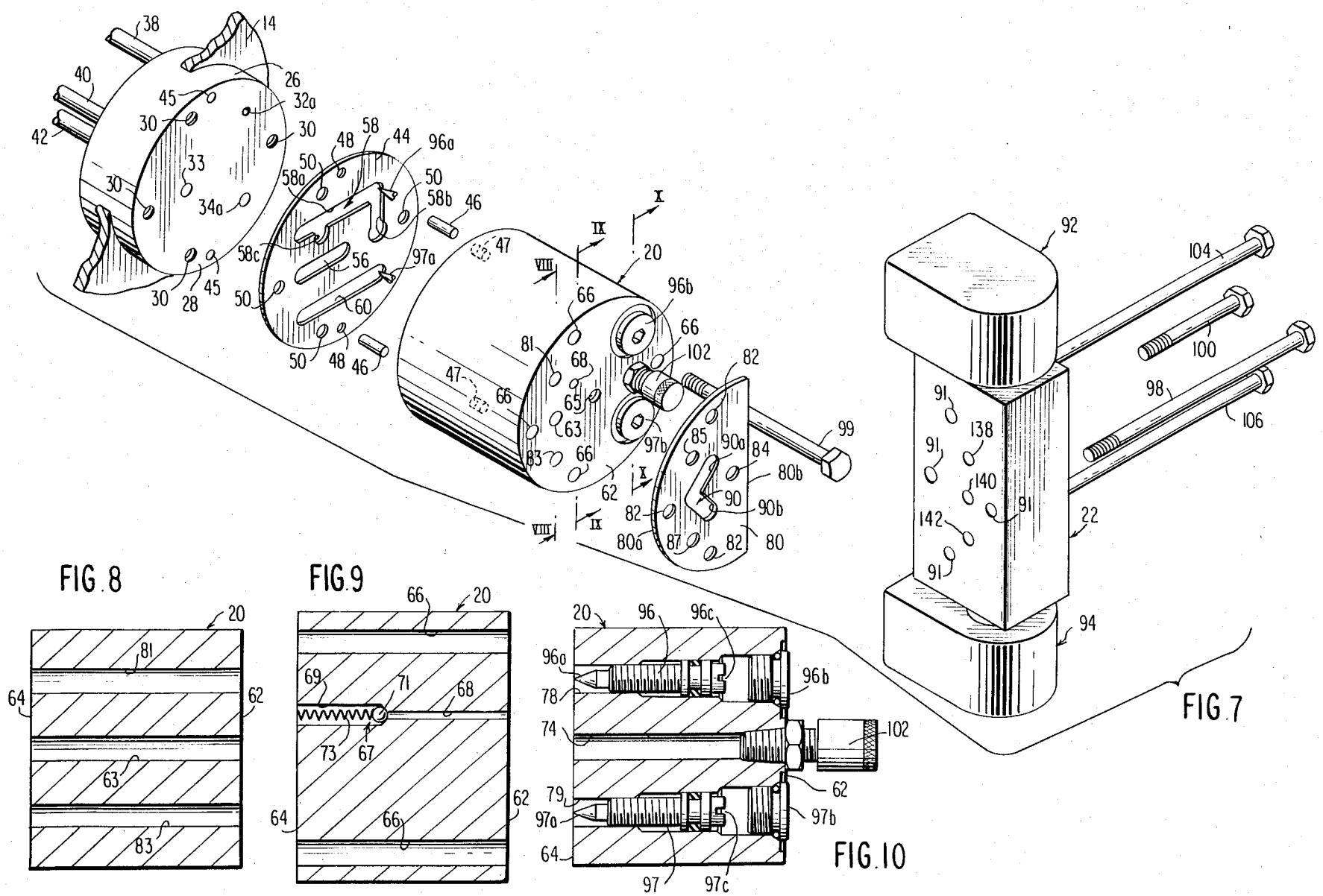
FIG. 7 is an exploded perspective view of the multi-block unloading control valve assembly integrated to an outer casing of a hermetic helical screw rotary compressor as illustrated in FIG. 1.
FIG. 8 is a longitudinal sectional view of a needle valve block forming a major component of the assembly of FIG. 7 taken about line VIII—VIII of that figure.
FIG. 9 is a longitudinal sectional view of the same component taken about line IX—IX of FIG. 7.
FIG. 10 is a longitudinal sectional view of the same component taken about line X—X of FIG. 7.
Figure 11:
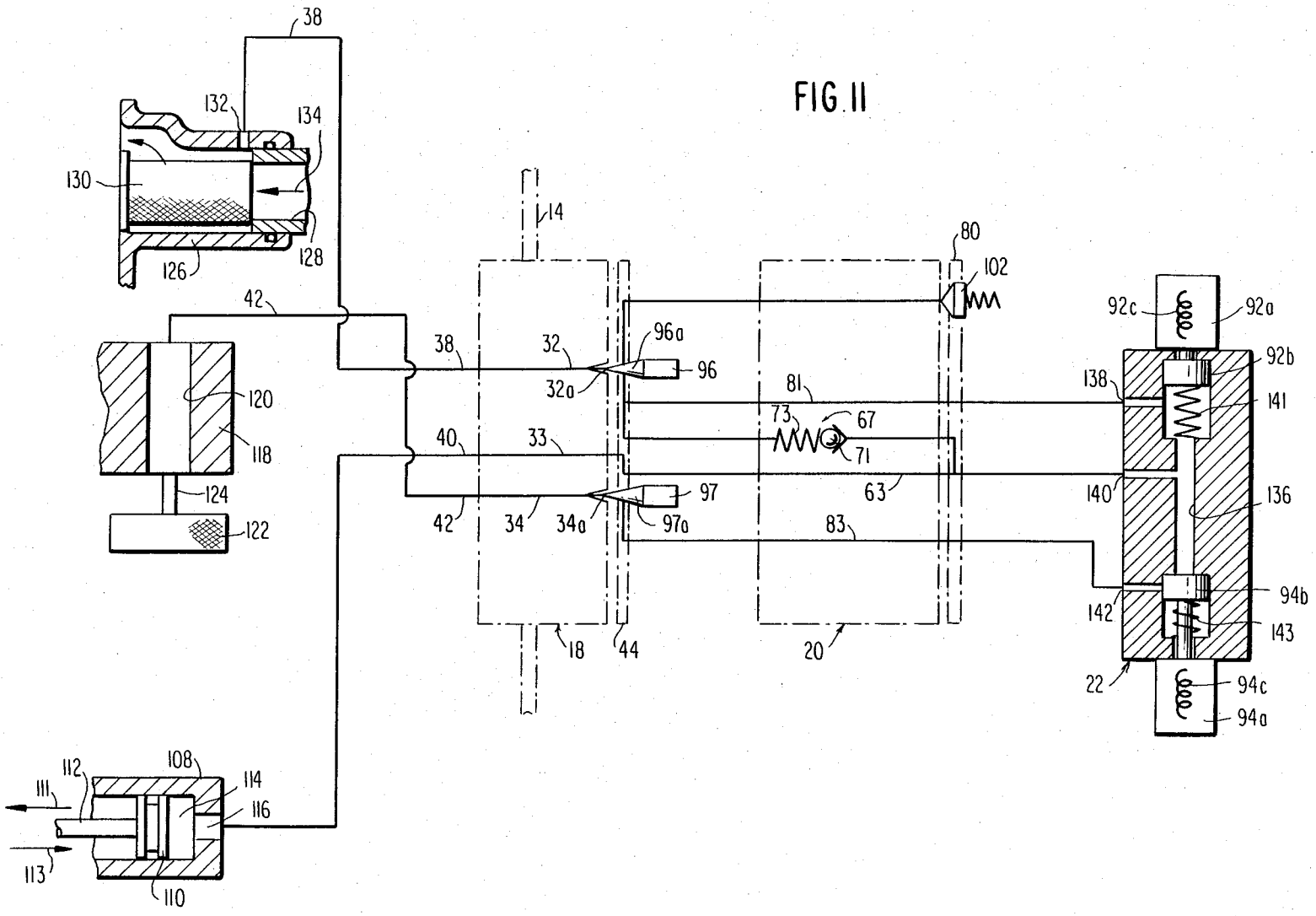
FIG. 11 is a partial hydraulic schematic diagram of the present invention illustrated in FIGS. 1–10 inclusive.
Figure 12:
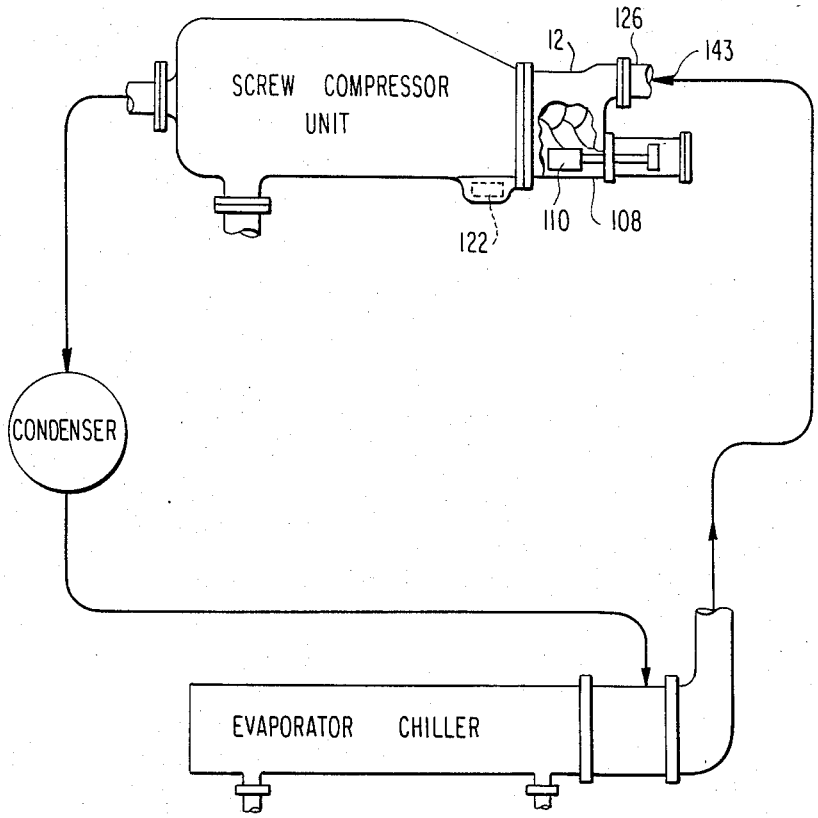
FIG. 12 is a schematic diagram of a refrigeration system incorporating the modular unload slide valve control assembly of the present invention of FIGS. 1–11.

There are three through holes or fluid passages within compressor block 18 in the form of drilled holes as at 32, 33, 34, FIGS. 7 and 11; holes 32 and 34 opening to end face 28 by way of enlarged conical recesses **32*a* and 34*a*, respectively. Mounted to the interior face 36 of compressor block 18 are suitable small diameter tubes or lines 38, 40 and 42, being sealably connected to respective through holes or passages 32, 33 and 34**.

As may be appreciated, there is no tubing or lines external to casing 14, these are completely done away with by the invention, and all lines are internal of the hermetic compressor unit, that is, inside the outer compressor casing 14. The nature in which the lines 38, 40 and 42 are connected to components internal of the hermetic compressor 12 may be best seen by reference to the hydraulic schematic diagram, FIG. 11. The first flow distribution plate 44 (as well as the second flow distribution plate 80), FIG. 7, function to transfer flow laterally relative to the longitudinal passages defined by parallel holes drilled within the various blocks 18, 20 and 22 and to seal flow connections at the block interfaces. In that respect plates or gaskets 44, 80 may be formed of neoprene for sealing effect and lateral flow passages are formed by way of slots within the same.

Thus, the flow distribution slots are formed within the gasket material so as to maintain the integrity of the lateral flow passages.

Flow distribution plate 44 is of thin disc form. In addition to the small diameter diametrically opposed locator holes 48 and four holes 50 are provided; being offset circumferentially about 90° and being aligned with the drilled and tapped holes 30 within the compressor block 18, thereby permitting the shank portions of mounting screws 98, 99, 104 and 106 to project therethrough.

Elongated flow distribution slots are provided within the flow distribution plate 44. A straight line slot 56 extends radially from the center of the plate 44 to the left, FIG. 7, and terminates at a positioning beyond drilled hole 33 within compressor block 18 leading to line 40. Slot 56 also underlies a hole or passage 63 extending through needle valve block 20.

Hole 63 is drilled the full extent of the needle valve block 20 from one end face 62 to the opposite end face 64. To the side of slot 56 within plate 44 there is provided a right angle slot indicated generally at 58 and comprised of right angle legs **58*a*, 58*b*. Leg 58*a* includes a slight pip as at 58*c* so as to be aligned with counterbore 69 of relief valve 67 borne by the needle valve block 20. Further, at the intersection of right angle passage slot portions 58*a*, 58*b*, this area opens to the bottom of a bored and counterbored hole or passage 78 within needle valve block 20 housing the unload needle valve 96 of modular unloading valve control assembly 10. Needle valve 96 has its needle point 96*a* projectable into female conical recess 32*a* at one end of hole 32, within face 28 of compressor block 18 at this intersection. Leg 58*b* of slot 58 terminates at a point underlying tapped hole 74 within needle valve block 20 housing a test point Scraeder valve 102, FIG. 11**.

A further straight line slot 60 is provided within the flow distribution plate 44 and acts to fluid communicate the load needle valve 97 mounted within passage or bore/counterbore 79 of needle valve block 20 to hole 34 within the compressor block 18 leading to line 42 internally of the compressor hermetic casing 14. Needle valve 97 has its needle point **97*a* projecting into female conical recess 34*a* formed within face 28 of compressor block 18, FIG. 7 and opening to hole 34**.

As best seen in FIGS. 8, 9 and 10, the needle valve block 20 comprises a relatively thick metal cylinder with its opposed end faces 62, 64 in contact with flow distribution plates 80 and 44, respectively. As may be appreciated best by viewing FIGS. 7 and 9, a series of holes 66 are drilled at locations corresponding to holes 30 within the compressor block 18 and holes 50 within flow distributor plate 44 through which extend the mounting screws 98, 99, 104, and 106. A tapped hole 65 is provided within end face 62 to an appropriate depth which threadably receives the end of central mounting screw 100 locking the solenoid valve block 22 to the end face 62 of needle valve block 20. The needle valve block 20 carries a bore 68 which is counterbored at 69. Counterbore 69 houses a sphere 71, spring biased by means of spring 73, to form the pressure relief valve indicated generally at 67. The needle valve block 20 is provided with a pair of passages 78, 79 and comprised of bore/counterbores within which fit unload rate needle valve 96 and load rate needle valve 97, respectively. The unload rate needle valve 96 and load rate needle valve 97 are accessible external of assembly 10, as may be seen, FIG. 10, by removing plugs **96*b* and 97*b* threaded thereto, respectively, permitting a screw driver to like adjustment tool to penetrate grooves 96*c*, 97*c* to rotate the needles to back off or advance the needle points 96*a*, 97*a* in conventional needle valve adjustment fashion, relative to recesses 32*a*, 34*a* of external face 28 of compressor block 18, respectively. Block 20 further carries drilled through holes or passages 81 and 83, FIG. 8**.

A tapped hole 74 has threaded thereto a refrigeration fitting Schraeder valve 102 closing off hole 74. Hole 74 leads to slot leg **58*b* opening to the suction side of the machine via pressure relief valve 67 and passage 78, such that access to suction pressure externally of the compressor hermetic unit 14 may be effected if required. A Scraeder valve 102** shown schematically, FIG. 11, functions as a test point and comprises a spring biased plunger, all fitted within hole 74.

Interposed between the needle valve block 20 and specifically face 62 thereof and face 22*b* of the solenoid valve block 22, is the second, thin, flow distribution plate or gasket 80. Plate 80 is formed of neoprene and is purposely of sector form including a rounded periphery 80*a* and a flat edge 80*b*. It bears three holes 82 through which pass screws 98, 104 and 106 whose headed ends contact end face 22*a* of the solenoid valve block 22. Additionally, a hole 84 is drilled through the center of flow distribution plate 80, and the screw 100 passes therethrough for sealably fixing the solenoid valve block 22 to end face 62 of the needle valve block 20 with the flow distribution plate 80 interposed therebetween. A single slot 90 having two 45° right angle legs 90*a*, 90*b* is formed within plate 80 functioning to connect passage 63 passing through needle valve block 20 to pressure relief valve passage 68 at that end of the valve assembly 10. As may be appreciated, constant diameter hole 63 and bore 68 within the needle valve block 20 cannot communicate laterally except at the end of the needle valve block, as provided by flow distribution plate slot 90. Holes 85 and 87 within plate 80 open to holes 81, 83 respectively in block 20.

Solenoid valve block 22 bears drilled holes 91 through which the mounting screws extend and carries a pair of solenoid valves comprising normally open unload solenoid valve indicated generally at 92 and normally closed load solenoid valve indicated generally at 94. The solenoid valves per se are conventional and are automatically energized, conventionally in the manner of U.S. Pat. Nos. 3,408,827; 3,738,116; and 3,795,117; from system temperature or pressure inputs. Enlarged housing portions 92*a* and 94*a* carry the solenoid coils 92*c*, 94*c*, respectively, functioning to attract plungers 92*b* and 94*b* (see schematic diagram, FIG. 11) and controlling fluid communication between a passage 140 and passages 138, 142 (for respective valves 92, 94). Block 22 includes internally a longitudinal bore or line 136 which intersects passages or lines 138, 140 and 142 at right angles. Plunger 92*b* is normally under spring bias by spring 141 such that when the coil 92*c* for solenoid valve 92 is energized, the plunger 92*b* shifts to close off normally open fluid communication between lines 138 and 136. To the opposite sense, for valve 94, with the coil 94*c* unenergized, the plunger 94*b* is positioned under spring bias by spring 143 so as to close off fluid communication between lines 136 and 142. Solenoid valve block comprises a three way valve, such that, with coil 92*c* energized and coil 94*c* de-energized, both solenoid valves are closed and hydraulic cylinder is locked. The line or longitudinal bore 136 connects intermediate of its ends to fluid passage 140 leading to fluid passage 63 within needle valve block 20 and passage 33 within compressor block 18. Further, passage 138 opens to passage 81 within the needle valve block 20 and passage 142 opens to passage 83 within the same block, FIG. 8.

Referring to the schematic diagram, FIG. 11, it may be appreciated that, internally of the compressor hermetic unit, tubes or lines 38, 40 and 42 are connected to respective sections of the compressor and function to provide a desired fluid communication between components thereof. For instance, line 38 opens to the suction side of the compressor. Compressor housing 12 includes rotor housing extension 126 which returns refrigerant from the refrigeration system to the compressor 12. Return fluid enters as per arrow 134, port 128 opening first to filter 130 and then to the helical screw compressor intermeshed threads defining with the casing 12 holding the same a compression chamber (not shown). The rotor housing extension 126 also includes a small radial port as at 132 which is connected to one end of tube 38 such that hydraulic fluid, i.e. lubricating oil under pressure may be returned to the suction side of the compressor from the chamber 114 of slide valve operating hydraulic cylinder 108 during slide valve unloading of the compressor. This is achieved by connecting tube 40 to port 116 opening directly to chamber 114 within cylinder 108 to one side of a piston 110 sealably carried by the cylinder 108 and being connected directly to a slide valve (not shown) by piston rod 112. The arrows 111, 113 indicate respectively load and unload directions for movement of the piston 110 in response to system requirements.

During unloading, the hydraulic fluid (oil) drains from chamber 114 without energizing the solenoid valves such that oil is fed to the suction side of the machine via tubes 40 and 38 at a rate determined by unload rate needle valve 96. The loading sequence involves first energizing coil 92*c* and then coil 94*c*.

Oil at compressor discharge pressure is available to the system for control purposes and specifically for supply to chamber 114 to drive the piston to the left and shift the slide valve in the direction of the load arrow 111 in the schematic diagram. In that respect, an oil strainer 122 immersed in the sump of the compressor hermetic unit and specifically within the bottom of compressor external housing or casing 14 picks up the oil and supplies the same through tube 124 to housing 14 whose bore 120 makes the connection to tube 42 leading to the compressor block 18. Passage 34 within compressor block 18 connects to passage 33 within valve block 20 and oil flows to solenoid valve block 22 for passage via passages 142, 136 and 140, upon energization of the normally closed load solenoid valve 94 and normally open solenoid valve 92 and is metered by load rate needle valve 97 to chamber 114 of the slide valve operating or drive cylinder 108. Flow to chamber 114 is by lines 24, passages 34 and 83 of blocks 18 and 20, respectively passages 142, 136 and 140 of solenoid valve block 22, passages 63 and 33 of blocks 20 and 18, respectively, and line or tube 40. With solenoid valve 92 energized and solenoid valve 94 de-energized, the piston 110 (and thus the slide valve) is hydraulically locked at a given compressor load position. With both solenoid valves deenergized, flow from chamber 114 is via tube 40, passage 33 of block 18, passage 63 of block 20, passages 140, 136 and 138 of block 22, further passage 81 of block 20, further passage 32 of block 18 and tube 32 to suction tube 126, metered by unload needle valve 96. It should be noted that pressure relief valve 67 functions to limit build up of pressure within cavity 114. If not, at unload, the cavity pressure must be blow down. Valve 67 shortens the response time for unloading.

As may be appreciated, the modular unloading valve assembly eliminates outside piping, permits ready maintenance of the assembly components, permits ready adjustment of the flow rates for the needle valves controlling unload and load flows from and to the slide valve cylinder chamber 114 and insures minimum viscosity of the oil functioning as a hydraulic fluid particularly at start up.

While the invention has been particularly shown and described with reference to a preferred embodiment thereof, it will be understood by those skilled in the art that various changes in form and details may be made therein without departing from the spirit and scope of the invention.

What is claimed is:

1. In combination, a hermetic helical screw rotary compressor for a closed loop refrigeration system or the like, having refrigerant circulating therein, said compressor comprising:

a hermetic outer casing receiving the discharge of the compressor, an inner casing defining with a pair of intermeshed helical screw rotors rotatably mounted therein, a compressor compression chamber, a suction port within said inner casing opening to said compression chamber, a capacity control slide valve hydraulic cylinder mounted to said inner casing and including a piston for shifting a slide valve slidably and sealably mounted within said hydraulic cylinder and defining with said cylinder a closed chamber, a compressor suction tube connected to the closed loop system for supplying refrigerant in vapor form to the suction port of the compressor, oil for lubricating and sealing purposes within the outer compressor casing and being subject to the discharge pressure of the compressed refrigerant vapor, a first tube in communication with the oil within compressor outer casing sump for providing a supply of oil as hydraulic fluid at discharge pressure and partially forming a first line, a second tube connected to said hydraulic cylinder for supplying said hydraulic fluid to said cylinder and for removing said hydraulic fluid therefrom and partially forming a second line, a third tube connected to the compressor suction tube for returning working fluid to the suction port of the compressor and partially forming a third line, an unload rate needle valve within said third line, a load rate needle valve within said first line, and solenoid valve means selectively connecting or disconnecting ones of said first and second and third lines, the improvement comprising:

a modular, multi-block unloading control valve assembly, said assembly comprising:

a compressor block fixedly and sealably mounted within the hermetic compressor outer casing and having internal and external faces, said compressor block including holes extending through the same forming parts of said first, second and third lines and being connected to ends of said first, second and third tubes respectively so as to maintain the exposed tubes internally of said hermetic compressor outr casing.

a needle valve block fixedly mounted to the external face of the compressor block, said needle valve block including passages extending therethrough, one of said passages carrying a pressure relief valve and others said unload rate needle valve and said load rate needle valve, respectively, and said solenoid valve means comprising a solenoid valve block fixedly mounted in face abutting position on said needle valve block, forming a three way solenoid valve and comprising a normally open unload plunger, a normally closed load plunger and passages opening to said plungers and connected to respective passages carried by said needle valve block, and means for removably, sealably fixing said blocks in a stacked array in end facing position includig means for fluid connecting respective passages of said blocks at their interfaces, such that said fluid passages internal of said compressor block, said needle valve block and said solenoid valve block insure minimum viscosity to the oil carried thereby as a result of compressor shut down for insured prompt proper slide valve operation at compressor start up.

2. The combination as claimed in claim 1, wherein said passages comprises longitudinal passages through said blocks laterally offset from each other and wherein said means for fluid connecting the passages within said compressor block, said needle valve block and said solenoid valve block comprise flow distribution plates sealably sandwiched between facing ends of respective blocks, said flow distribution plates comprising elongaged slots formed within said plates opening to said longitudinal passages and functioning to permit lateral flow between laterally offset longitudinal passages of respective blocks sandwiching a given flow distribution plate.

3. The combination as claimed in claim 2, wherein said solenoid valve block is narrower than the needle valve block to which it is mounted, and wherein certain of the longitudinal passages within needle valve block open to an end surface thereof to one side of the solenoid valve block and wherein said certain passages bear respectively said unload rate needle valve and said load rate needle valve to permit external adjustment of said needle valves to adjust the flow rates thereof.

4. The combination as claimed in claim 3, wherein said solenoid valve block comprises an elongated parallelpiped body, and wherein said passages within said solenoid valve block comprise an internal longitudinal bore extending in end-to-end fashion from said normally open unload plunger to said normally closed load plunger, said plungers being oppositely directed, said passages further comprising three holes extending inwardly from the face of said solenoid valve block abutting the flow of distribution plate interposed between said solenoid valve block and needle valve block, said three holes intersecting said solenoid valve block bore at right angles thereto and wherein said plungers are operatively positioned relative to said solenoid valve block longitudinal bore and said three holes such that said plungers function to selectively close off and open communication between two of said three holes and said longitudinal bore, and wherein said solenoid valve block further comprises selectively energizable unload and load coils in juxtaposition to said plungers to effect shifting of said plungers upon energization thereof; whereby, energization of said unload solenoid coil without energization of said load coil, causes said plungers to cut off communication between the source of hydraulic fluid and the slide valve actuating cylinder chamber and between said actuating cylinder chamber and the compressor suction tube to hydraulically lock the slide valve at a given load/unload position, energizing neither of said coils permits said slide valve to shift to full unload position, and by energizing the both coils, oil is fed under pressure to said slide valve actuating cylinder chamber to drive said slide valve towards compressor full load position.

5. The combination as claimed in claim 3, wherein the external face of said compressor block includes conical recesses at positions underlying the load and unload rate needle valves carried by said needle valve block said recesses opening to longitudinal passages within said compressor block, and wherein said needle valves have needle points and are mounted within said needle valve block in positions such that their needle points are adjustably received within said conical recesses to vary the rate of flow through the longitudinal passages thereof, said needle valves are threadably mounted within said passages carrying respectively said load and unload rate needle valves at their ends proximate to said compressor block, and wherein the ends of said passages carring said needle valves remote from said compressor block, carry removable plugs exposed to the assembly exterior of said outer casing to prevent direct access to the needle valves absent their removal.

6. The combination as claimed in claim 4, wherein the external face of said compressor block includes conical recesses at positions underlying the load and unload rate needle valves carried by said needle valve block said recesses opening to longitudinal passages within said compressor block, and wherein said needle valves have needle points and are mounted within said needle valve block in positions such that their needle points are adjustably received within said conical recesses to vary the flow rate of fluid passage through the longitudinal passages thereof, said needle valves are threadably mounted within said passages carrying respectively said load and unload rate needle valves at their ends proximate to said compressor block, and wherein the ends of said passages carrying said needle valves remote from said compressor block, carry removable plugs exposed to the assembly exterior of said outer casing to prevent direct access to the needle valves absent their removal.

* * * * *